US009389587B2

(12) United States Patent
Von Gruenigen et al.

(10) Patent No.: US 9,389,587 B2
(45) **Date of Patent: *Jul. 12, 2016**

(54) PART FOR A TIMEPIECE MOVEMENT

(71) Applicant: Omega SA, Bienne (CH)

(72) Inventors: Cedric Von Gruenigen, Neuchatel (CH); Christian Charbon, Chezard-St-Martin (CH); Marco Verardo, Les Bois (CH)

(73) Assignee: Omega S.A., Bienne (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/852,074

(22) Filed: Sep. 11, 2015

(65) Prior Publication Data

US 2015/0378309 A1 Dec. 31, 2015

Related U.S. Application Data

(63) Continuation of application No. 14/154,673, filed on Jan. 14, 2014, now Pat. No. 9,182,742.

(30) Foreign Application Priority Data

Jan. 17, 2013 (EP) ..... 13151669

(51) Int. Cl.

| | |
|---|---|
| ***G04B 13/02*** | (2006.01) |
| ***G04B 15/14*** | (2006.01) |
| ***G04B 1/16*** | (2006.01) |

(52) U.S. Cl.

CPC *G04B 13/02* (2013.01); *G04B 1/16* (2013.01); *G04B 13/026* (2013.01); *G04B 15/14* (2013.01); *Y10T 29/49* (2015.01)

(58) Field of Classification Search

USPC ..... 368/124, 127, 130, 169, 322–325; 29/896.31

See application file for complete search history.

(56) References Cited

U.S. PATENT DOCUMENTS

| | | | |
|---|---|---|---|
| 2,865,791 | A | 12/1958 | Wilhelm et al. |
| 3,034,286 | A | 5/1962 | Bourquin |

(Continued)

FOREIGN PATENT DOCUMENTS

| | | | |
|---|---|---|---|
| CH | 477 718 | A | 5/1969 |
| CH | 554 501 | A | 9/1974 |

(Continued)

OTHER PUBLICATIONS

European Search Report issued Aug. 6, 2013, in Patent Application No. EP 13 15 1669, filed Jan. 17, 2013 (with English Translation).

(Continued)

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A metal pivot pin includes at least one pivot at at least one of its ends, and the metal is an austenitic steel, an austenitic cobalt alloy, or an austenitic nickel alloy in order to limit a sensitivity of the pin to magnetic fields. At least an outer surface of the at least one pivot is hardened to a predetermined depth relative to the rest of the pin in order to harden the at least one pivot.

19 Claims, 2 Drawing Sheets

(56) References Cited

U.S. PATENT DOCUMENTS

| | | | |
|---|---|---|---|
| 3,199,978 | A | 8/1965 | Brown et al. |
| 3,683,616 | A | 8/1972 | Steinemann et al. |
| 7,833,906 | B2 | 11/2010 | Knapp et al. |
| 7,966,969 | B2 | 6/2011 | Hasper et al. |
| 2004/0062151 | A1 | 4/2004 | Miyama |
| 2010/0002548 | A1 | 1/2010 | Hessler et al. |
| 2011/0286312 | A1 | 11/2011 | Murakami et al. |
| 2011/0292770 | A1 | 12/2011 | Damasko |

FOREIGN PATENT DOCUMENTS

| | | | |
|---|---|---|---|
| EP | 2 065 107 | A1 | 6/2009 |
| JP | 5884968 | A | 5/1983 |
| JP | 59-35673 | | 2/1984 |
| JP | 2003214526 | A | 7/2003 |
| WO | WO 2011/161193 | A1 | 12/2011 |

OTHER PUBLICATIONS

Japanese Office Action dated Nov. 25, 2014, in JP Patent Application No. 2014-006503 (with English translation).

PART FOR A TIMEPIECE MOVEMENT

CROSS-REFERENCE TO RELATED APPLICATIONS

This application is a continuation of U.S. application Ser. No. 14/154,673 filed Jan. 14, 2014, which claims priority to European patent application No. 13151669.2 filed Jan. 17, 2013; and the entire contents of each of the above are hereby incorporated by reference herein.

FIELD OF THE INVENTION

The invention relates to a part for a timepiece movement and particularly to a non-magnetic pivot pin for a mechanical timepiece movement and more particularly to a non-magnetic balance staff, pallet staff and escape pinion.

BACKGROUND OF THE INVENTION

The manufacture of a pivot pin for a timepiece consists in performing bar turning operations on a hardenable steel bar to define various active surfaces (shoulder, projecting portion, pivots, etc.) and then in subjecting the bar-turned pin to heat treatments including at least one hardening operation to improve the hardness of the pin and one or more tempering operations to improve the roughness. The heat treatment operations are followed by an operation of rolling the pin pivots, which consists in polishing the pivots to the required dimensions. The rolling operation also improves the hardness and the roughness of the pivots. It will be noted that this rolling operation is very difficult or even impossible to achieve with materials having a low hardness, i.e. less than 600 HV.

The pivot pins, for example the balance staffs, conventionally used in mechanical timepiece movements are made in grades of bar turning steel which are generally martensitic carbon steels including lead and manganese sulphides to improve their machinability. A known steel of this type, designated 20AP, is typically used for these applications.

This type of material has the advantage of being easy to machine, in particular of being suitable for bar turning and, after hardening and tempering, has superior mechanical properties which are very advantageous for making timepiece pivot pins. These steels have, in particular, superior wear resistance and hardness after heat treatment. Typically, the hardness of pin pivots made of 20AP steel can exceed 700 HV after heat treatment and rolling.

Although this type of material provides satisfactory mechanical properties for the timepiece applications described above, it has the drawback of being magnetic and able to disrupt the working of a watch after being subjected to a magnetic field, particularly when the material is used to make a balance staff cooperating with a balance spring made of ferromagnetic material. This phenomenon is well known to those skilled in the art and is for example described in the *Bulletin Annuel Suisse de Chromométrie* Vol. I, pages 52 to 74. It should also be noted that these martensitic steels are also corrosion sensitive.

Attempts have been made to overcome these drawbacks with austenitic stainless steels which have the peculiarity of being non-magnetic, i.e. paramagnetic or diamagnetic or antiferromagnetic. However, these austenitic steels have a crystallographic structure which means that they cannot be hardened or achieve hardnesses and thus wear resistances compatible with the requirements necessary for making timepiece pivot pins. One means of increasing the hardness of these steels is cold working; however this hardening operation cannot achieve hardnesses of more than 500 HV. Consequently, for parts which require high resistance to wear due to friction and pivots which have little or no risk of deformation, the use of this type of steel remains limited.

Another approach for attempting to overcome these drawbacks consists in depositing on the pivot pins hard layers of materials such as diamond-like-carbon (DLC). However, there have been observed significant risks of delamination of the hard layer and thus the formation of debris which can move around inside the watch movement and disrupt the operation of the timepiece, which is unsatisfactory.

Yet another approach has been envisaged for overcoming the drawbacks of austenitic stainless steels, namely the superficial hardening of the pivot pins by nitriding, carburizing or nitrocarburizing. However, these treatments are known to cause a significant loss of corrosion resistance because of the reaction of the nitrogen and/or carbon with the chromium in the steel and the formation of chromium nitride and/or chromium carbide causing localised depletion of the chromium matrix, which is detrimental to the desired timepiece application.

SUMMARY OF THE INVENTION

It is an object of the invention to overcome all or part of the aforementioned drawbacks by proposing a pivot pin which both limits sensitivity to magnetic fields and can achieve an improved hardness compatible with the demands for wear and shock resistance required in the horological industry.

It is also an object of the invention to provide a non-magnetic pivot pin having improved corrosion resistance.

It is yet another object of the invention to provide a non-magnetic pivot pin which can be manufactured simply and economically.

The invention therefore relates to a metal pivot pin for a timepiece movement including at least one pivot at at least one of the ends thereof, characterized in that the metal is an austenitic steel, an austenitic cobalt alloy or an austenitic nickel alloy so as to limit its sensitivity to magnetic fields and in that at least the external surface of said at least one pivot is hardened to a determined depth relative to the core of the pin.

Consequently, a superficial area or the entire pin is hardened, i.e. the core of the pin may be barely modified or unmodified. Through this selective hardening of portions of the pin, the pivot pin can enjoy advantages such as low sensitivity to magnetic fields, and hardness in the main stress areas, in addition to good corrosion resistance while still maintaining good general roughness. Moreover, the use of this type of austenitic steel is advantageous in that the steel is highly machinable.

In accordance with other advantageous features of the invention:

- the predetermined depth represents between 5% and 40% of the total diameter d of the pivot, typically between 5 and 35 microns;
- the hardened outer surface includes diffused atoms of at least one chemical element, said at least one chemical element being a non-metal and preferably nitrogen and/or carbon;
- the hardened outer surface has a hardness of more than 1000 HV.

Moreover, the invention relates to a timepiece movement, characterized in that the movement includes a pivot pin according to any of the preceding variants, and in particular a balance staff, a pallet staff and/or an escape pinion including a pin according to any of the preceding claims.

Finally, the invention relates to a method of manufacturing a pivot pin including the following steps:

a) forming a pivot pin from a base of austenitic steel, an austenitic cobalt alloy or an austenitic nickel alloy to limit its sensitivity to magnetic fields, including at least one pivot at at least one end thereof;

b) diffusing atoms to a predetermined depth at least on the outer surface of said at least one pivot in order to harden the pivot pin in the main areas of stress while maintaining a high roughness.

Consequently, by diffusing atoms in the steel or in the cobalt or nickel alloy, a superficial area or all the pivots are hardened without having to deposit a second material on top of the pivots. Indeed, the hardening occurs within the material of the pivot pin which, advantageously according to the invention, prevents any subsequent delamination which can occur where a hard layer is deposited on the pin.

Further, this thermochemical treatment, which is intended to diffuse carbon and/or nitrogen atoms in the interstitial sites of the alloy, in principle does not form carbons and/or nitrides which could damage the corrosion resistance of the pivot pins.

In accordance with other advantageous features of the invention:

- the predetermined depth represents between 5% and 40% of the total diameter d of the pivot;
- the atoms include at least one chemical element, which is preferably a non-metal such as nitrogen and/or carbon;
- step b) consists of a thermochemical diffusion treatment;
- step b) consists of a process of ionic implantation and diffusion treatment;
- the pivots are rolled or polished after step b).

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

The invention relates to a part for a timepiece movement and particularly to a non-magnetic pivot pin for a mechanical timepiece movement.

The invention will be described below with reference to an application to a non-magnetic balance staff 1. Of course, other types of timepiece pivot pins may be envisaged such as, for example, timepiece wheel set arbours, typically escape pinions or pallet staffs.

Figure 1:
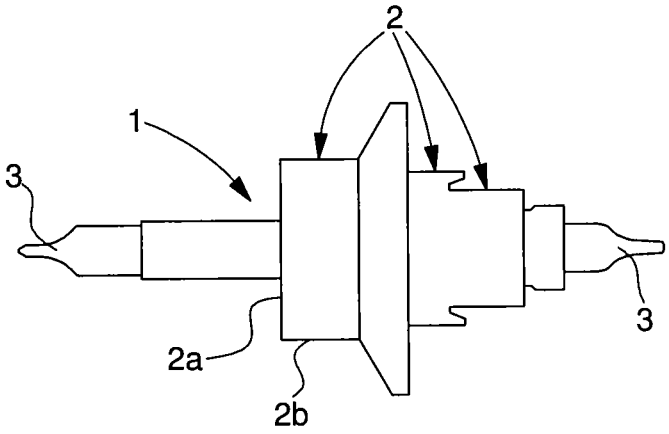
FIG. 1 is a diagram of a pivot pin according to the invention.

Referring to FIG. 1, there is shown a balance staff 1 according to the invention, which includes a plurality of sections 2 of different diameters conventionally defining shoulders 2*a* and projecting portions 2*b* arranged between two end portions defining pivots 3. These pivots are intended each to pivot in a bearing typically in an orifice in a jewel or ruby.

With the magnetism induced by objects that are encountered on a daily basis, it is important to limit the sensitivity of balance staff 1 to avoid affecting the working of the timepiece in which it is incorporated.

Figure 2:
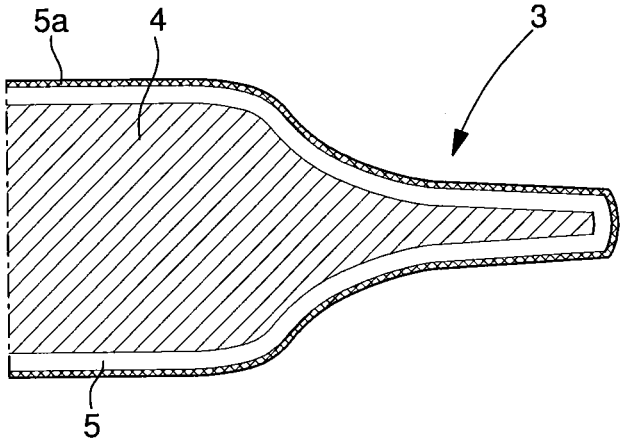
FIG. 2 is a partial cross-section of a balance staff pivot according to the invention, after the diffusion treatment operation and before the rolling or polishing operation.
Figure 3:
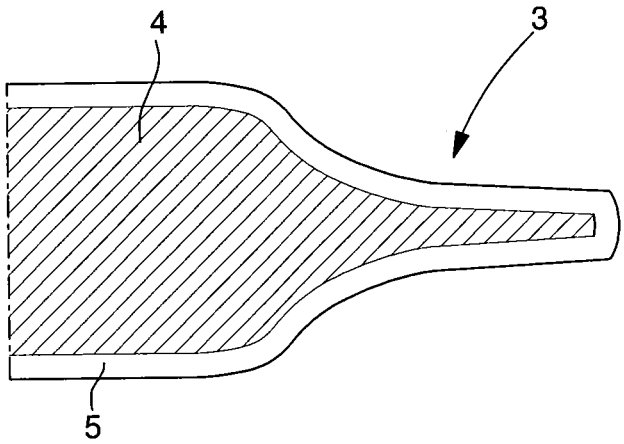
FIG. 3 is a partial cross-section, similar to that of FIG. 2, illustrating a pivot after the diffusion treatment operation and before the rolling or polishing operation.

Surprisingly, the invention overcomes both problems at the same time with no comprise and provides additional advantages. Thus, metal 4 of staff 1 is an austenitic and preferably stainless steel so as to advantageously limit the sensitivity of the staff to magnetic fields. Further, at least the outer surface 5 of the pivots (FIGS. 2 and 3) is hardened to a predetermined depth relative to the rest of the balance staff, so as to offer, advantageously according to the invention, a superior hardness on said outer surface while maintaining high roughness.

Indeed, according to the invention, it was possible to obtain hardnesses of more than 1000 HV on the outer surface of pivots 3. The above values were obtained from 316L chromium-nickel austenitic stainless steel comprising at least 16.5% Cr and 10% Ni (DIN X2CrNiMo17-12-2+Su+Cu) with added sulphur and manganese sulphide. Of course, other austenitic stainless steels may be envisaged provided their constituent proportion confers paramagnetic, diamagnetic or antiferromagnetic properties and good machinability.

It has been empirically demonstrated that a hardening depth of between 5% and 40% of the total diameter d of pivots 3 is sufficient for application to a balance staff. By way of example, if the radius d/2 is 50 μm, the hardening depth is preferably approximately 15 μm around pivots 3. Evidently, depending upon the application, it is possible to provide a different hardening depth of between 5% and 80% of the total diameter d.

Preferably according to the invention, the hardened outer surface 5 of pivots 3 includes diffused atoms of at least one non-metal such as nitrogen and/or carbon. Indeed, as explained below, through the interstitial saturation of atoms in steel 4, a superficial area 5 is hardened with no requirement to deposit a second material on top pivots 3. Indeed, the hardening occurs within the material 4 of pivots 3 which, advantageously according to the invention, prevents any subsequent delamination during use.

Consequently, at least one superficial area 5 is hardened, i.e. the core of pivots 3 and/or the rest of the pin may remain barely modified or unmodified without any significant change to the mechanical properties of balance staff 1. As a result of this selective modification of pivots 3 of balance staff 1, advantages such as low sensitivity to magnetic fields, hardness and high roughness in the main areas of stress, can be combined, while maintaining good corrosion and fatigue resistance.

The invention also relates to the method of manufacturing a balance staff as explained above. The method of the invention advantageously includes the following steps:

a) forming a balance staff 1 from a base of austenitic steel to limit the sensitivity thereof to magnetic fields, including pivots 3 at each end of the staff;

b) diffusing atoms to a predetermined depth at least on the outer surface 5 of pivots 3 so as to harden the pivots in the main areas of stress.

According to a first preferred embodiment, pivots 3 are rolled or polished after step b) in order to achieve the dimensions and final surface finish required for pivots 3. As a result of this rolling operation after the treatment pins are obtained with improved wear and shock resistance relative to pins whose pivots have only undergone the hardening operation.

Figure 4:
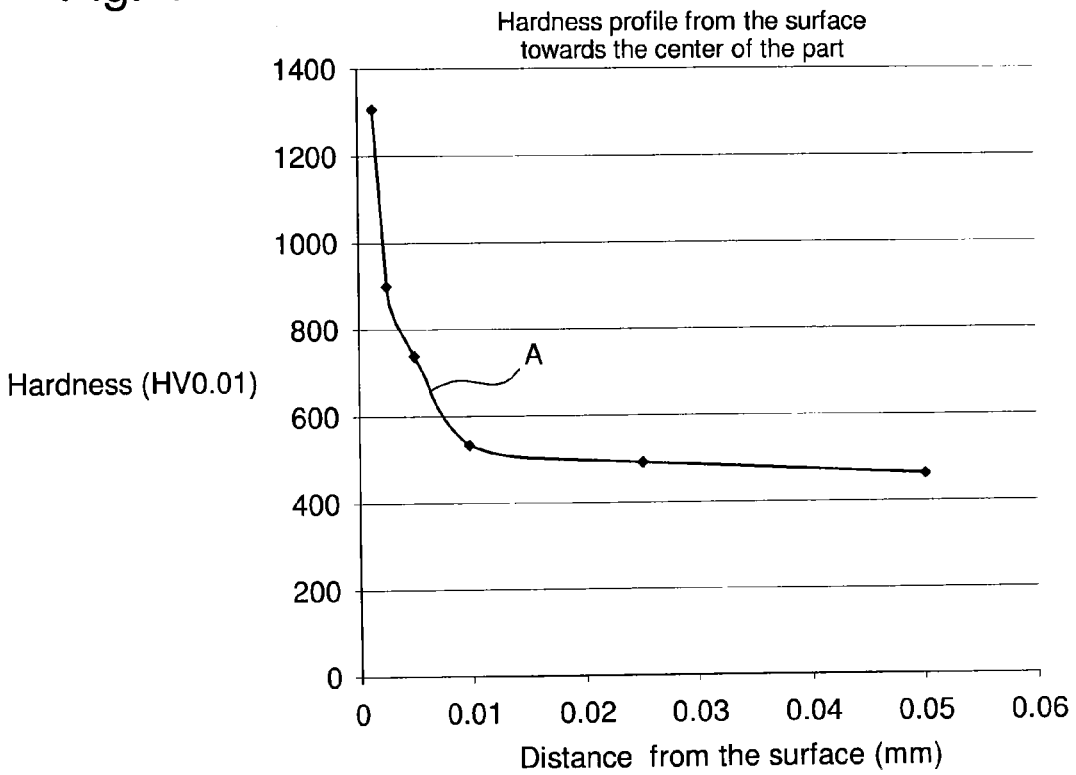
FIGS. 4 and 5 are graphs illustrating the hardness profile towards the core of a balance staff pivot according to the invention, after the diffusion operation, and respectively before and after the rolling or polishing operation.
Figure 5:
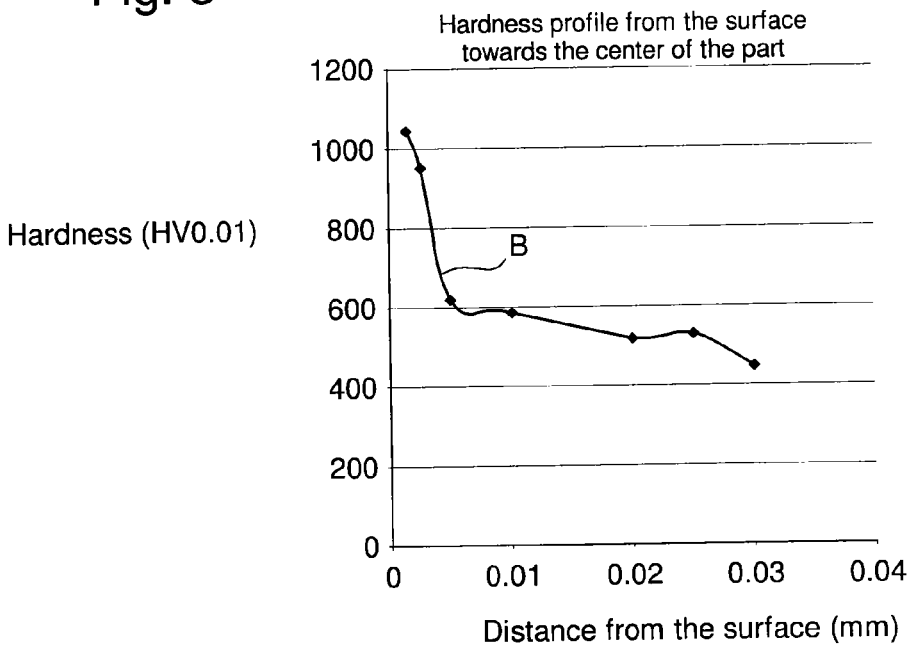

It will be noted from the graphs illustrated in FIGS. 4 and 5, which were made on the basis of a balance staff all of whose surfaces had undergone the step b) diffusion treatment, that the surface hardness of the pin, including the surface of the pivots 3 thereof, achieve a hardness of around 1300 HV (curve A, FIG. 4). It will also be noted that against all expectation, the rolling operation which removed a portion of superficial layer 5*a* (the dark layer in FIG. 2) also removed the hardest part of superficial layer 5 of pivots 3 but that the superficial hardness of pivots 3 (curve B, FIG. 5) advantageously remains more than 1000 HV, which gives pivots 3 very satisfactory wear resistance properties for the application concerned.

Advantageously according to the invention, regardless of the embodiment, the method can be applied in bulk. Thus, step b) may consist of a thermochemical treatment such as cementing or nitriding several balance staffs and/or several balance staff blanks. It is clear that step b) may consist of the interstitial diffusion in steel 4 of atoms of a chemical element, preferably a non-metal such as nitrogen and/or carbon. Finally, advantageously, it was discovered that the compressive stresses of the method improve fatigue and shock resistance.

Step b) could also consist of an ionic implantation process and/or a heat diffusion treatment. This variant has the advantage of not limiting the type of diffused atoms and of allowing both interstitial and substitutional diffusion.

Of course, this invention is not limited to the illustrated example but is capable of various variants and alterations which will be clear to those skilled in the art. In particular, it is possible to envisage entirely or virtually entirely treating pivots 3, i.e. treating more than 80% of the diameter d of pivots 3, although this is not necessary for the application to pivot pins such as timepiece balance staffs.

According to the invention, the basic material for making a pivot pin may also be an austenitic cobalt alloy including at least 39% cobalt, typically an alloy known as DIN K13C20N16Fe15D7 typically having 39% Co, 19% Cr, 15% Ni and 6% Mo, 1.5% Mn, 18% Fe and the remainder comprised of additives, or an austenitic nickel alloy including at least 33% nickel, typically an alloy known as MP35N® typically with 35% Ni, 20% Cr, 10% Mo, 33% Co and the remainder comprised of additives.

What is claimed is:

1. A pivot pin for a timepiece movement, comprising:

at least one pivot at one or more ends of the pin, wherein the pin is formed of a metal that is an austenitic cobalt alloy or an austenitic nickel alloy so as to limit a sensitivity of the pin to magnetic fields, and at least an outer surface of said at least one pivot includes diffused atoms that harden the austenitic cobalt alloy or the austenitic nickel alloy of the outer surface to a predetermined depth relative to a core of the pin.

2. The pivot pin according to claim 1, wherein the hardened outer surface includes an interstitial saturation of the diffused atoms.

3. The pivot pin according to claim 1, wherein the predetermined depth represents between 5% and 40% of a total diameter of the at least one pivot.

4. The pivot pin according to claim 1, wherein the hardened outer surface includes the diffused atoms of at least one chemical element.

5. The pivot pin according to claim 4, wherein said at least one chemical element is a non-metal.

6. The pivot pin according to claim 5, wherein said non-metal is at least one of nitrogen and carbon.

7. The pivot pin according to claim 1, wherein the hardened outer surface includes a hardness of more than 1000 HV.

8. The pivot pin according to claim 1, wherein the pin includes two pivots.

9. A movement for a timepiece wherein the movement comprises the pivot pin according to claim 1.

10. A movement for a timepiece wherein the movement comprises at least one of a balance staff, a pallet staff, and an escape pinion including the pivot pin according to claim 1.

11. A pivot pin for a timepiece movement, comprising:

at least one pivot at one or more ends of the pin, wherein the pin is formed of a metal that is selected from among a group comprising austenitic chromium-nickel stainless steels including at least 16.5% Cr and 10% Ni, austenitic cobalt steels including at least 39% cobalt, and austenitic nickel steels including at least 33% nickel, and at least an outer surface of said at least one pivot includes diffused atoms that harden the metal of the outer surface, which is selected from among the group, to a predetermined depth relative to a core of the pin.

12. The pivot pin according to claim 11, wherein the hardened outer surface includes an interstitial saturation of the diffused atoms.

13. The pivot pin according to claim 11, wherein the metal forming the pin is selected from among a group including X2CrNiMo17-12-2+Su+Cu austenitic steels when the pin is made of an austenitic chromium-nickel stainless steel, K13C20N16Fe15D7 austenitic type cobalt alloys when the pin is made of an austenitic cobalt steel, and the austenitic nickel alloy including a composition of 35% Ni, 20% Cr, 10% Mo, 33% Co and a remainder comprised of additives when the pin is made of an austenitic nickel steel.

14. The pivot pin according to claim 11, wherein the predetermined depth represents between 5% and 40% of a total diameter of the at least one pivot.

15. The pivot pin according to claim 11, wherein the hardened outer surface includes the diffused atoms of at least one chemical element.

16. The pivot pin according to claim 11, wherein the hardened outer surface includes a hardness of more than 1000 HV.

17. The pivot pin according to claim 11, wherein the pin includes two pivots.

18. A movement for a timepiece wherein the movement comprises the pivot pin according to claim 11.

19. A movement for a timepiece wherein the movement comprises at least one of a balance staff, a pallet staff, and an escape pinion including the pivot pin according to claim 11.

* * * * *